US011319972B1

(12) United States Patent
Kulkarni et al.

(10) Patent No.: US 11,319,972 B1
(45) Date of Patent: May 3, 2022

(54) HYDRAULIC CYLINDER SNUBBING RETENTION ARRANGEMENT

(71) Applicant: Caterpillar Inc., Peoria, IL (US)

(72) Inventors: Prasanna V. Kulkarni, Naperville, IL (US); Kurt S Goslovich, Naperville, IL (US); Anand Jason Vedaraj, Chennai (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/317,264

(22) Filed: May 11, 2021

(51) Int. Cl.
*F15B 15/22* (2006.01)
*F15B 15/14* (2006.01)
*E02F 9/22* (2006.01)

(52) U.S. Cl.
CPC ..... *F15B 15/222* (2013.01); *F15B 15/1442* (2013.01); *F15B 15/224* (2013.01); *E02F 9/22* (2013.01)

(58) Field of Classification Search
CPC ..... F15B 15/222; F15B 15/223; F15B 15/224
See application file for complete search history.

(56) References Cited

U.S. PATENT DOCUMENTS 3,704,650 A * 12/1972 Berg ..... E02F 9/2203 91/395
4,006,666 A * 2/1977 Murray ..... F15B 15/222 91/394
4,352,318 A * 10/1982 Kolchinsky ..... F15B 15/222 91/395
4,386,555 A * 6/1983 Horiuchi ..... F15B 15/222 91/20
6,558,430 B1 * 5/2003 Nakaya ..... F15B 15/223 623/44
7,798,052 B2 * 9/2010 Ikari ..... F15B 15/222 91/394
8,353,241 B1 * 1/2013 Manney, III ..... F15B 15/226 92/85 B
10,151,333 B2 * 12/2018 Besliu ..... F16J 1/12
10,352,337 B2 * 7/2019 Monden ..... F15B 15/149
2016/0273559 A1 * 9/2016 Takai ..... F15B 15/14

FOREIGN PATENT DOCUMENTS

CN 202132305 2/2012
CN 102865265 1/2013
CN 203685765 7/2014
CN 106286471 1/2017

* cited by examiner

*Primary Examiner* — Michael Leslie
(74) *Attorney, Agent, or Firm* — Schwegman, Lundberg & Woessner

(57) ABSTRACT

A hydraulic cylinder may include a housing having a rod end and a cap end and the cap end may include a snubbing bore. The cylinder may also include a rod having a working end outside the housing and extending through a rod end of the cylinder to a piston end. The cylinder may also include a piston arranged within the housing on the piston end of the rod and configured to articulate within the housing between the rod end and the cap end. The piston may have a longitudinal bore extending into a cap side of the piston and the bore may include a retainer lip. The cylinder may also include a snubber configured for engaging the snubbing bore of the cap end when the piston approaches the cap end of the housing. The snubber may have an annular flange configured for retention by the retainer lip.

18 Claims, 6 Drawing Sheets

HYDRAULIC CYLINDER SNUBBING RETENTION ARRANGEMENT

CLAIM OF PRIORITY

This patent application claims the benefit of priority to IN Application No. 202111012359, filed Mar. 23, 2021, which is incorporated by reference herein in its entirety.

TECHNICAL FIELD

The present application relates generally to hydraulic systems such as those used on work machines including excavators, trucks, or other heavy equipment for construction, farm implements, and other machines adapted for performing work. More particularly, the present application relates to a snubbing system for a hydraulic cylinder that slows the speed of the piston within the cylinder as the piston approaches a cap end of the cylinder. Still more particularly, the present application relates to a retention system for a snubbing element arranged on a piston within a hydraulic cylinder.

BACKGROUND

Hydraulic cylinders generally include a cylinder with a piston arranged therein that is configured to reciprocate back and forth within the cylinder based on the flow of hydraulic fluid into and out of the cylinder. A rod may be secured to the piston and be adapted to do work based on movement of the piston. For example, the rod may extend out an end of the cylinder and be secured at an opposite end to an implement such as an excavation tool, a truck bed, or another actuatable element. In an effort to cushion or control the speed of the piston as it approaches a cap end or a rod end of the cylinder, or both, snubbing features may be provided. In some cases, snubbing may be provided outside of the cylinder and may be in the form of restricted orifices in a hydraulic valve used to control the cylinder, for example. The restricted orifices may slow the exit of hydraulic fluid from the cylinder and, thus, slow the speed of the piston. In other cases, snubbing may be provided within the cylinder by restricting the flow of hydraulic fluid leading to a port on the cylinder, for example.

In some particular designs, snubbing within a hydraulic cylinder may include a sleeve placed over the rod on one or both sides of the piston. The sleeve may extend away from the piston for a relatively short distance along the rod and may provide an increased diameter of the rod. The cap end and rod end of the cylinder may include a snubbing bore that the sleeve is inserted into as the piston approaches a respective end of the cylinder. A hydraulic port may be provided in the snubbing bore and the relatively tight fit of the sleeve in the snubbing bore may restrict the flow of hydraulic fluid through the reduced annular area around the sleeve a to the port.

The sleeves placed over the rod may be secured in place with snap rings, retainer rings, and other securing mechanisms. Side loading, vibration, and/or impact loading of the hydraulic cylinder can dislodge the snap rings, retainer rings and other securing mechanisms. Once dislodged, the securing mechanisms can become broken apart within the cylinder and can contaminate the hydraulic fluid and damage the inner workings of the cylinder.

Chinese patent application 2021132305 discloses a high-pressure oil cylinder with a buffering device in a rod cavity. A throttling device is arranged on an end face of one end of the cylinder sleeve close to the piston, and a throttling member is arranged in the throttling orifice. A buffering sleeve is sleeved on the piston rod, a first stair is arranged at a position on the outer circumference of the piston rod, the buffering sleeve is sleeved on the position, and a second stair is arranged on the inner circumference of the buffering sleeve. The outer circumference of one end of the buffering sleeve close to the cylinder sleeve is a cone face. The high-pressure oil cylinder has the advantages of being capable of achieving gradually throttling, remitting the impact of the piston to the cylinder barrel, lowering the starting pressure during starting of the oil cylinder and the like.

SUMMARY

In one or more embodiments, a hydraulic cylinder may include a housing having a rod end and a cap end and the cap end may include a snubbing bore. The cylinder may also include a rod having a working end outside the housing and extending through a rod end of the cylinder to a piston end. The cylinder may also include a piston arranged within the housing on the piston end of the rod and configured to reciprocate within the housing between the rod end and the cap end. The piston may have a longitudinal bore extending into a cap side of the piston and the bore may include a retainer lip. The cylinder may also include a snubber configured for engaging the snubbing bore of the cap end when the piston approaches the cap end of the housing. The snubber may have an annular flange configured for retention by the retainer lip.

In one or more embodiments, a snubbing assembly for a hydraulic cylinder may include a piston having a generally cylindrical outer surface and a first end and a second end. The piston may be configured for securing to a rod of the hydraulic cylinder and may have a longitudinal bore extending into the first end of the piston. The longitudinal bore having a retainer lip. The assembly may also include a snubber configured for engaging a snubbing bore of a cap end of the cylinder when the piston approaches the cap end. The snubber may have an annular flange configured for retention by the retainer lip.

In one or more embodiments, a method of assembling a hydraulic cylinder may include placing a snubber on a mandrel of a rod. The method may also include sleevably placing the piston over the snubber and securing the piston to the rod until it is seated against a shoulder of the rod. A seated position of the piston may secure a flange of the snubber and allow for radial and longitudinal movement of the snubber relative to the mandrel.

DETAILED DESCRIPTION

Figure 1:
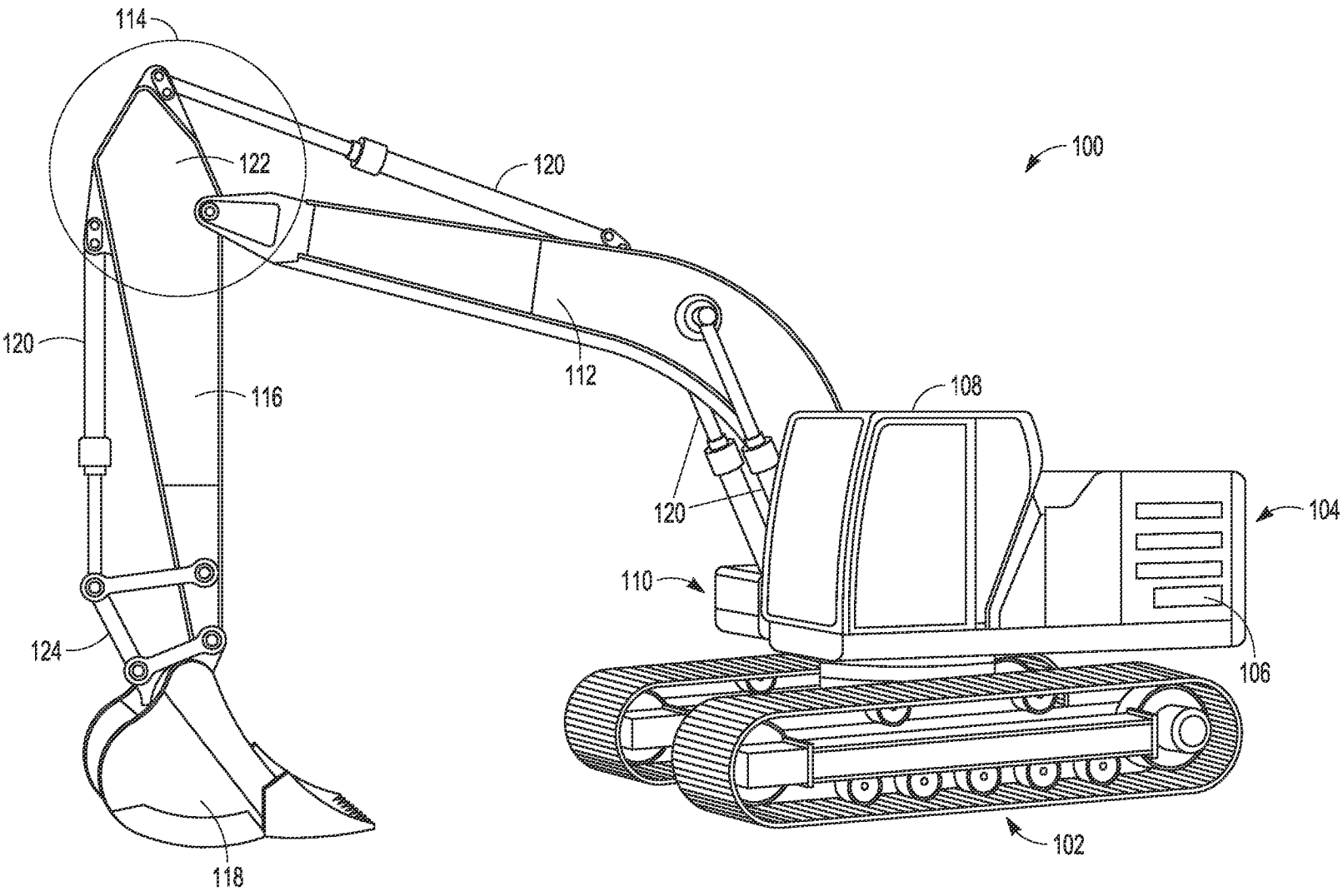
FIG. 1 is a perspective view of a work machine having a hydraulic cylinder, according to one or more embodiments.

FIG. 1 is a perspective view of a work machine 100. As shown, the work machine 100 may be an excavator that is well suited for digging and/or lifting material and loading trucks, for example. Still other types of work machines including trucks with articulating truck beds, skid steers, or other work machines having hydraulic systems may be provided. The work machine 100 may include a plurality of ground supporting traction elements 102 (e.g., wheels, tracks, skid feet, etc.) for translating the work machine 100 relative to a supporting surface. The traction elements 102 may include a pair of tracks and a bridge may extend between the tracks and pivotally support a machine deck 104. The machine deck may include an engine house 106 for providing power to machine, a cab 108 for interacting with an operator to control the work machine, and a lift arm base 110 for pivotal attachment of a primary or inner lift arm 112. The primary or inner lift arm may be a pivoting lift arm extending away from the machine deck 104 to a knuckle 114, where a secondary or outer lift arm 116 may pivotally extend. The secondary or outer lift arm 116 may extend away from the primary or inner lift arm 112 to an opposite end where a bucket 118 may be pivotally secured.

As shown, the work machine 100 may include a hydraulic system for operating the lift arms 112/114 and bucket 118. For example, the hydraulic system may include a pair of hydraulic cylinders 120 arranged on either side of the primary lift arm 112. This pair of hydraulic cylinders 120 may extend to pivot the primary lift arm 112 upward and retract to pivot the primary lift arm 112 downward. An additional hydraulic cylinder 120 may be arranged on the primary lift arm 112 and secured to a lever 122 on the secondary lift arm 116. This hydraulic cylinder 120 may extend to cause the outer lift arm 116 to curl inward relative to the primary lift arm 112 and may retract to straighten the outer lift arm 116 relative to the primary lift arm 112. Still a third hydraulic cylinder 120 may be arranged on the outer lift arm 116 and may be secured to a lever 124 of the bucket 118. This hydraulic cylinder 120 may extend to cause the bucket to curl inward relative to the outer lift arm 116 and may retract to straighten the bucket relative to the outer lift arm 116. The hydraulic system may include a hydraulic fluid tank, a pump for delivering fluid to the system, and a control valve for controlling the routing of the hydraulic fluid to and from the cylinders from the pump and back to the tank.

Figure 2:
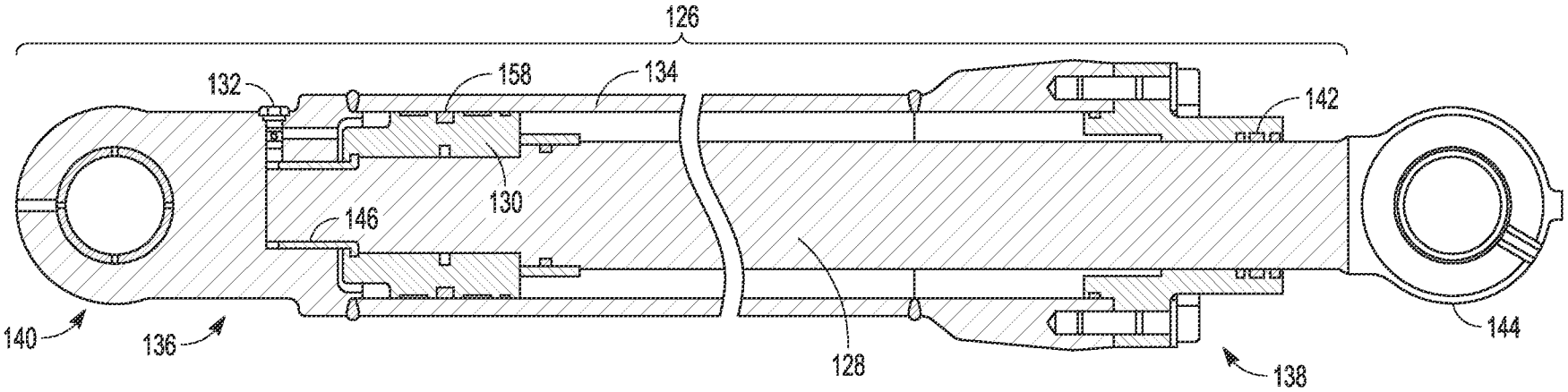
FIG. 2 is a cross-sectional view of one or more of the hydraulic cylinders of the work machine of FIG. 1, according to one or more embodiments.

Referring now to FIG. 2, a cross-section of a hydraulic cylinder 120, such as one of the hydraulic cylinders 120 of the work machine 100 of FIG. 1, is shown. The hydraulic cylinder 120 may be configured to extend and retract a rod to perform work such as pivoting a lift arm or a bucket of the work machine. As shown, the hydraulic cylinder may include a housing 126, a rod 128, a piston 130, and one or more ports 132 for delivering and/or receiving hydraulic fluid from the hydraulic cylinder 120.

With continued reference to FIG. 2, the housing 126 may be configured to contain and withstand relatively high fluid pressures and guide the piston 130 along a pathway allowing the piston 130 to reciprocate back and forth through a stroke length based on fluid flow on one more sides of the piston 130. The housing 126 may include a cylinder wall 134 defining a longitudinally extending cylinder. The housing may also include a cap end 136 and a rod end 138. The cap end 136 may be a substantially closed end of the cylinder having a port 132 for the introduction or ejection of hydraulic fluid. The cap end 136 may include a lug 140 for securing the hydraulic cylinder 120 to the work machine 100. In one or more embodiments, the lug 140 may include an eye for receiving a pin or bolt allowing the hydraulic cylinder 120 to pivot relative to its connection to the work machine 100 or implement of the work machine 100. The rod end 138 may close off of the end of the cylinder with respect to the piston 130 and the hydraulic fluid, but may include a sealed opening 142 for passing through of the rod 128. Like the cap end 136, the rod end 138 may include a port for the introduction or ejection of hydraulic fluid. As may be appreciated, as fluid flows into the hydraulic cylinder at the cap end 136 and out of the hydraulic cylinder at the rod end 138, the piston 130 may reciprocate within the housing 134 to drive the rod 128 from cylinder and extend the overall length of the hydraulic cylinder 120. As fluid flows out of the cap end 136 and fluid flows into the rod end 138, the piston 130 may reciprocate within the housing 126 to retract the rod 128 into the cylinder and shorten the extension of the overall hydraulic cylinder 120.

With continued reference to FIG. 2, the rod 128 may be secured to the piston 130 and may include a longitudinal element having a diameter smaller than the housing and adapted for sleevably articulating within the housing based on articulation of the piston 130. The rod 128 may be secured to the piston 130 at one end, may extend through the rod end 138 of the housing 126, and may include a lug or other attachment feature 144 on an opposite end. The lug or other attachment feature 144 may allow the rod to be secured to the work machine 100 or an implement of the work machine 100 and the lug may provide for pivoting motion of the connection by way of a pinned or bolted connection, for example.

Figure 3:
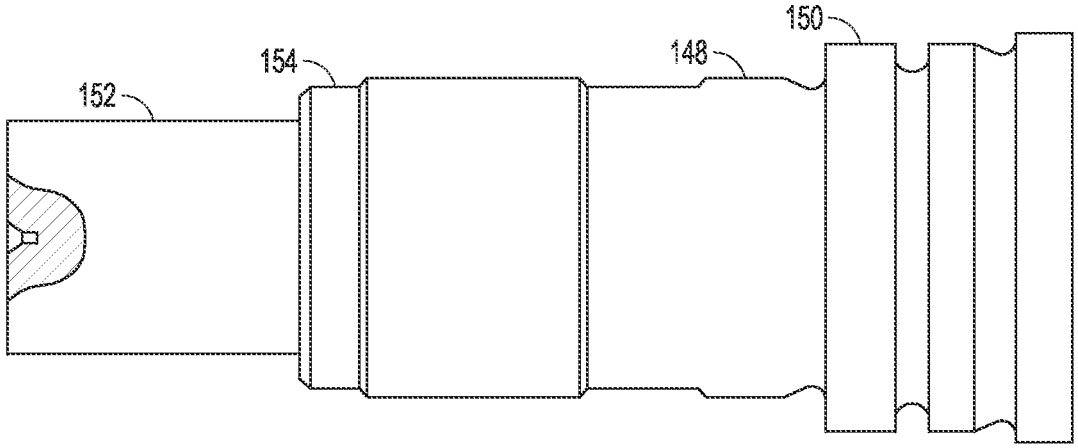
FIG. 3 is a side view of a piston end of a rod of the hydraulic cylinder of FIG. 2, according to one or more embodiments.
Figure 5:
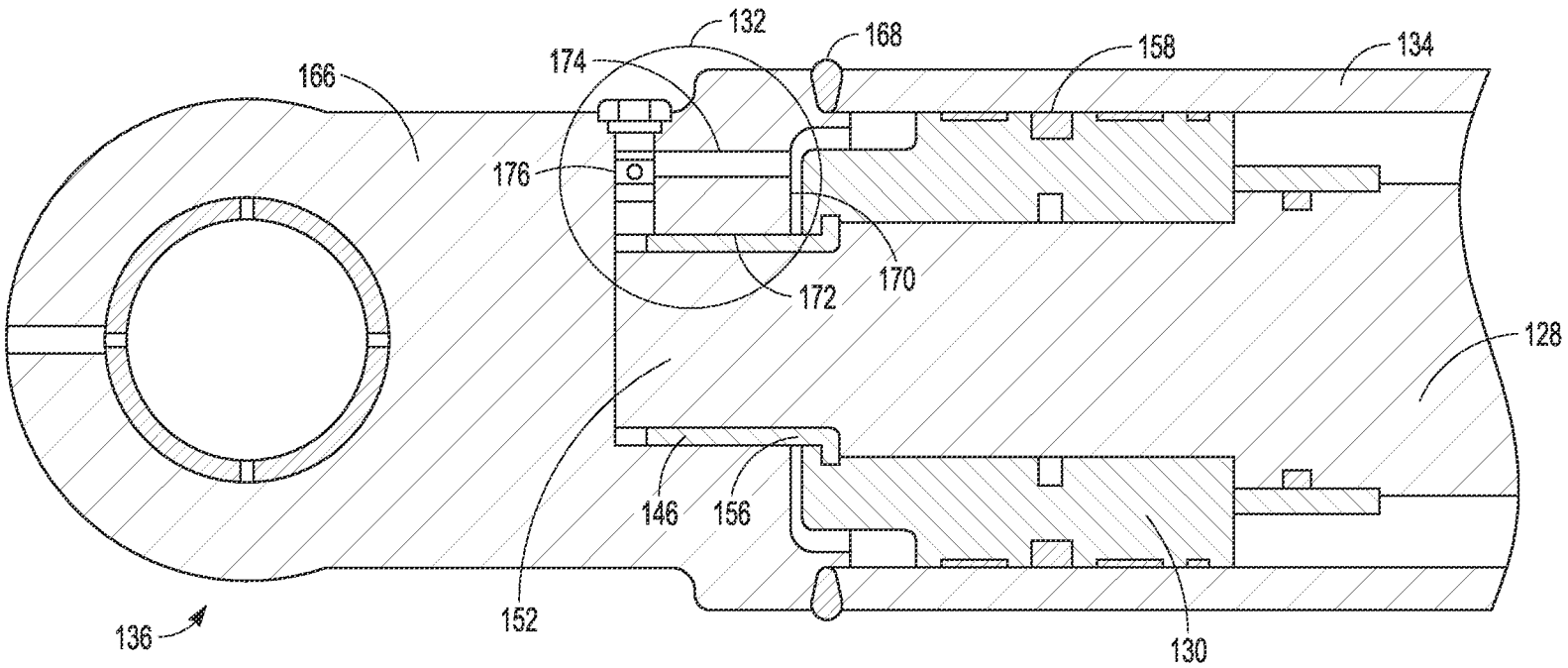
FIG. 5 is a close-up cross-sectional view of the cap end of the hydraulic cylinder of FIG. 2, according to one or more embodiments.

At the piston end of the rod 128, as shown in FIG. 3, the rod 128 may include coupling features for coupling the rod 128 to the piston 130 and for interacting with a snubber 146, described in more detail below. For example, the piston end of the rod 128 may include a threaded region 148 and be adapted for insertion into and/or through the piston 130 for threadably engaging the piston 130 and the rod 128. In one or more embodiments, the rod 128 may include a piston shoulder 150 that acts as a stop for the piston 130 and against which the piston may be forced to tighten the piston 130 onto the rod 128. The rod 128 may also include an extension portion or mandrel 152 that extends through and beyond the piston 130 when the piston 130 is secured to the rod 128. The mandrel 152 may be adapted to receive and hold the snubber 146. In particular, the mandrel 152 may have a diameter slightly smaller than the threaded region 148 of the piston rod 128. The diameter of the mandrel 152, for example, may range from approximately 72 mm to approximately 76 mm, or from approximately 73 mm to approximately 75 mm, or a diameter of approximately 74 mm may be provided. The smaller diameter of the mandrel may provide a shoulder 154 against which the snubber 146 may be seated to prevent longitudinal motion of the snubber 146 upward or longitudinally into the piston 130. The shoulder 154 between the mandrel 152 and the rod 128 may be positioned relative to the piston shoulder 150 and relative to the longitudinal length of the piston 130 such that the shoulder 154 is arranged within the piston 130 when the piston is secured to the rod 128. As shown in FIG. 5, the narrower size of the mandrel 152 relative to the through bore of the piston 130 may establish an annular recess 156 in the cap side of the piston 130 when the rod 128 is positioned therein. This annular recess 156 may be adapted for connection of the snubber 146. While a threaded connection between the piston 130 and the rod 128 has been described, still other connection or coupling techniques may be used such as a two-part piston that clamps over the rod, laterally extending through bolts or dowels, set screws, a flanged and bolted connection, or other attachment techniques.

As shown in FIG. 2, the piston 130 may be arranged within the housing 126 and may be adapted to reciprocate through the housing 126 based on fluid flow into and out of the housing 126 on either side of the piston. The piston 130 may sealingly engage the inner wall of the housing 126 so as to avoid, reduce, or minimize fluid flow passed the piston 130 within the housing 126. As such, as fluid pressures build up on one side of the piston 130 and exceed fluid pressures on the opposite side of the piston 130, the piston 130 may propagate toward the lower pressure side. In one or more embodiments, the piston 130 may be a cylindrical element having an outer diameter only slightly smaller than the inner diameter of the cylinder wall of the housing 126. One or more seals 158 may be arranged on the piston 130 to provide the sealing engagement with the inner surface of the housing 126.

Figure 4:
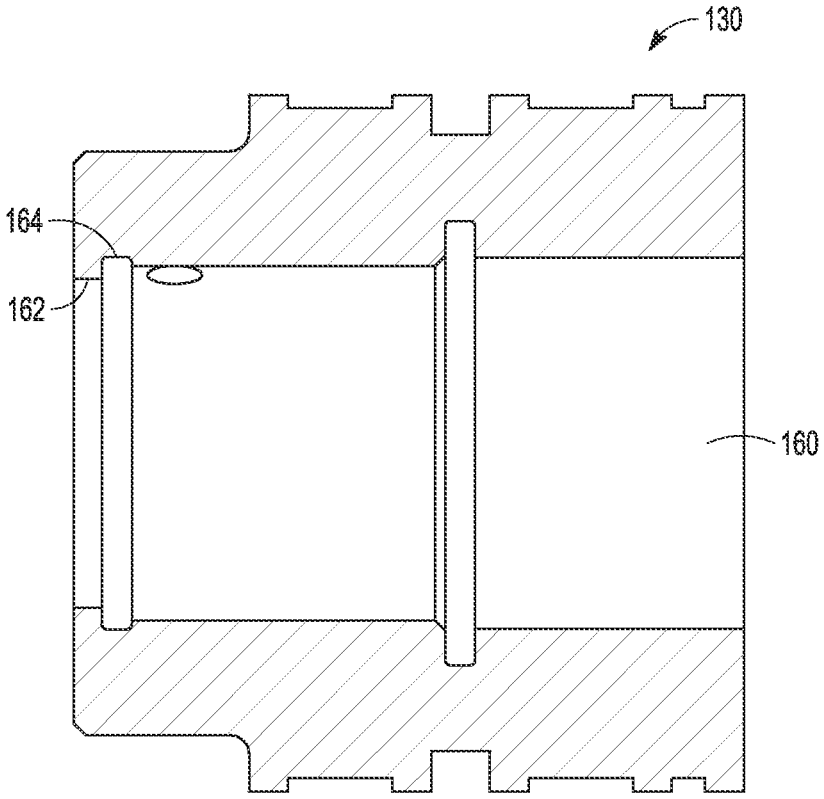
FIG. 4 is a cross-sectional view of a piston of the hydraulic cylinder of FIG. 2, according to one or more embodiments.

With reference to FIG. 4, the piston 130 may include a through bore 160 for receiving and engaging the rod 126. That is, as mentioned, the piston 130 may threadably engage the rod 126 and, as such, may include a threaded through bore 160 adapted to threadably secure the piston 130 to the rod 128. In one or more embodiments, the through bore may have a diameter ranging from approximately 95 mm to approximately 99 mm, or from approximately 96 mm to approximately 98 mm, or a diameter of approximately 97 mm may be provided. In one or more embodiments several different diameters may be provided. In one or more embodiments, and as described in more detail below, the piston 130 may include a snubber 146 on one or both sides of the piston 130 allowing for snubbing or cushioning of the piston 130 as it approaches the cap end 136 and rod end 138 of the cylinder 120. For purposes of engaging the snubber 146, the bore 160, at the cap side of the piston 130, may include a retainer lip 162 adapted to secure the snubber 146. The retainer lip 162 may reduce the diameter of the bore 160 at the cap side edge. In one or more embodiments, the retainer lip 162 may define a reduced bore diameter ranging from approximately 88 mm to approximately 90 mm, or a reduced bore diameter of approximately 89 mm may be provided. In one or more embodiments, a circumferential groove 164 extending radially into the inside surface of the bore 160 may also be provided just longitudinally inside or adjacent the retainer lip 162 to provide room for lateral play or movement of the snubber. In one or more embodiments, the groove depth beyond the inner bore diameter may range from approximately 2 mm to approximately 8 mm, or from approximately 3 mm to approximately 6 mm, or a groove depth of approximately 4 mm may be provided.

As shown in FIG. 2, the port or ports 132 of the hydraulic cylinder 120 may be adapted to deliver or receive hydraulic fluid from the hydraulic cylinder 120 and may be arranged at opposite ends of the housing 126 (i.e., one at the cap end 136 and one at the rod end 138). The ports 132 may provide for connection of hydraulic fluid lines and may provide the pathway for hydraulic fluid to enter and exit the hydraulic cylinder 120.

Referring now to FIG. 5, a close up view of the interaction between the piston 130 and the cap end 136 of the cylinder 120 is shown. The cap end 136 of the cylinder 120 may be adapted for securing the cylinder 120 to the work machine 100 or an implement thereof, containing cylinder pressure, and providing a port 132 for hydraulic fluid. As shown, the cap end 136 may include a bulkhead casting 166 adapted for securing to the housing 126. As shown, the bulkhead casting 166 may be welded to the cylinder wall 134 at a circumferentially extending weld 168. The bulkhead casting 166 may include a piston stop surface 170. A snubbing bore 172 may extend through the piston stop surface 170 defining the piston stop surface as an annular surface. The snubbing bore 172 may be smaller in diameter than the inner diameter of the cylinder wall 134 and may be sized and adapted to receive a snubber 146 on a cap side of the piston 130. In one or more embodiments, the snubbing bore 172 may have a diameter similar to the reduced bore diameter of the piston created by the retainer lip 162. In one or more embodiments, the snubbing bore may have a diameter ranging from approximately 88 mm to approximately 90 mm, or a reduced bore diameter of approximately 89 mm may be provided.

With continued reference to FIG. 5, the port 132 for introducing and receiving hydraulic fluid into the and out of the cylinder may include one or more pathways within the bulkhead casting 166. For example, as shown, the port 132 may include a main fluid filling bore 174 extending from a hose nipple on an outer surface of the bulkhead casting 166 up to and through the annular stop surface. This bore 174 may be relatively large and may allow for generally free flow of fluid into the hydraulic cylinder when the rod 128 is being extended. However, this relatively large fluid filling bore may include a check valve 176 such as a ball valve that closes when fluid is flowing out of the cylinder. In this situation, fluid flow out of the cylinder may flow into the snubbing bore 172 and out of an exit bore 176 extending from the snubbing bore 172 to the hose nipple on the outside surface of the bulkhead casting 166.

Figure 6:
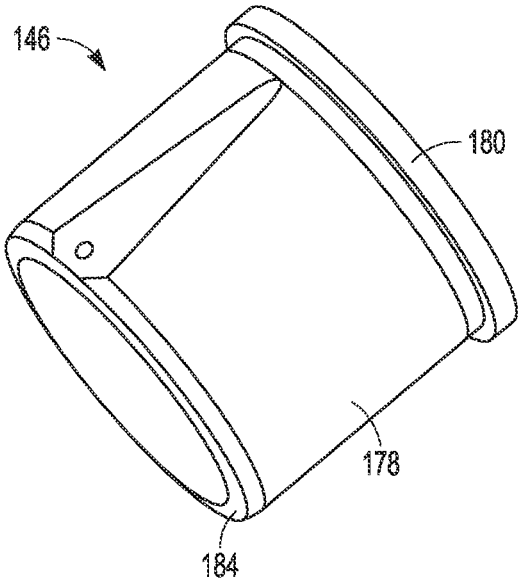
FIG. 6 is a perspective view of a snubber of the hydraulic cylinder of FIG. 2, according to one or more embodiments.
Figure 7:
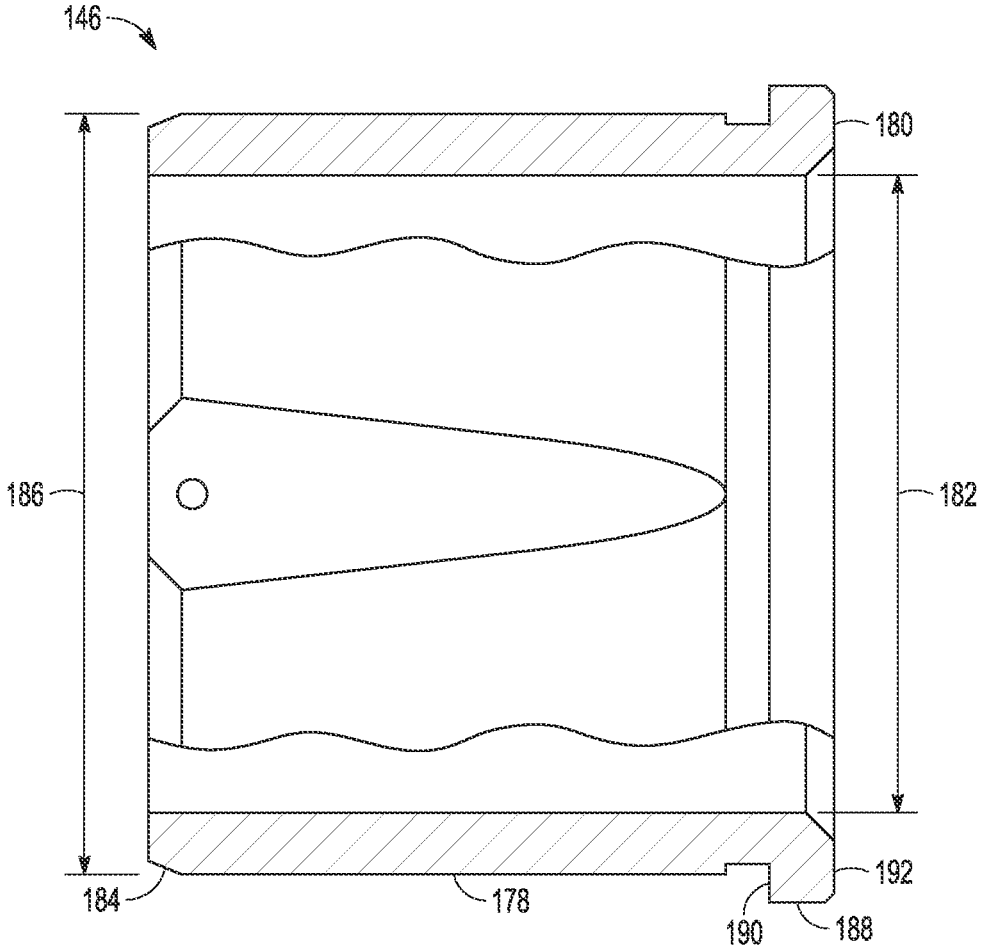
FIG. 7 is a cross-sectional view thereof.

With continued reference to FIG. 5, a snubber 146 is shown on the cap side of the piston 130. As shown and as mentioned above, the rod 128 may extend through the piston 130 and create a mandrel 152 for receiving the snubber 146 on a cap side of the piston 130. The snubber 146 may be adapted to sleevably engage the mandrel 152. During operation, the snubber 146 may be adapted to substantially fill the snubbing bore 172 of the cap end 136 as the piston 130 approaches the cap end 136 of the cylinder 120 and, as such, restrict fluid flow to the exit bore 176 causing the travel speed of the piston toward the cap end 136 to slow down. The snubber 146 may include a sleeve portion 178 and a flange portion 180 and is shown in detail in FIGS. 6 and 7.

As shown, the sleeve portion 178 of the snubber 146 may include a cylindrical sleeve wall extending longitudinally along the mandrel portion 152 of the rod 128 extending beyond the piston 130. The cylindrical sleeve wall may have an inner diameter 182 slightly larger than the mandrel 152 and may be adapted for a loose or slipping engagement with the rod. For example, the inner diameter 182 of the cylindrical sleeve wall may range from approximately 73 mm to approximately 77 mm, or from approximately 74 mm to approximately 76 mm, or a diameter of approximately 75 mm may be provided. This may be compared to the mandrel diameter of approximately 74 mm providing for a small gap providing for a loose fit of the snubber 146 on the mandrel 152. The cylindrical sleeve wall 178 may have an outer diameter 186 adapted to substantially fill the snubbing bore 172. For example, the outer diameter may range from approximately 86 mm to approximately 90 mm, or from approximately 87 mm to approximately 89 mm, or an outer diameter of approximately 88 mm may be provided. When compared to the snubbing bore diameter of approximately 89 mm, a small gap between the outside of the snubber 146 and the snubbing bore 172 may be provided. It is to be appreciated that to allow for sleeving the piston 130 over the snubber 146 during assembly, the outer diameter of the cylindrical sleeve wall 178 may be slightly smaller than the reduced bore diameter provided at the retainer lip 162 on the bore of the piston. It is to be further appreciated that as cylinder size and capacities change, the housing, rod, and piston size may change and, as such, the snubbing bore and snubber may be increased or decreased in size accordingly. The sleeve wall 178 may include a free end and a piston end. The free end may include a chamfered nose 184 extending around the circumference of the sleeve wall. The chamfered nose 184 may create a tapered end on the snubber 146 and provide a centering function as the snubber 146 approaches and engages the snubbing bore 172. The piston end of the sleeve wall 178 may be secured to the flange portion 180 of the snubber 146.

The flange portion 180 of the snubber may be adapted for engagement with the piston 130 to secure the snubber 146 to the piston 130 and about the rod 128 or mandrel portion 152 of the rod 128. The connection to the piston 130 may be a relatively loose fit connection to maintain the snubber 146 free to rotate about the mandrel 152 and free to move slightly longitudinally. As shown, the flange portion 180 may include a radially outward extending plate forming a circumferential edge 188, a mandrel side annular face 190 and a piston side annular face 192. The diameter of the circumferential outer edge 188 may be selected for sleevingly passing through the bore 160 of the piston 130 (e.g., smaller than the bore), but for catching on the cap side retainer lip 162 of the bore of the piston 130. The groove 164 on the inside surface of the piston 130 may be slightly larger than the diameter of the circumferential outer edge 188 (e.g., the groove having a diameter larger than the bore) and may allow for lateral play in the snubber 146 relative to the piston 130. In one or more embodiments, the circumferential outer edge 188 may have a diameter ranging from approximately 93 mm to approximately 97 mm, or approximately 94 mm to approximately 96 mm, or a diameter of approximately 95 mm may be provided. The larger diameter of the (e.g., 95 mm) flange of the snubber as compared to the reduced bore diameter of the piston (e.g., 89 mm), may place the mandrel side annular face 190 in bearing with the inside surface of the retainer lip 162 when the piston is sleeved over the snubber 146.

It is to be appreciated that the piston 130 and the snubber 146 may be considered a snubbing assembly. In one or more embodiments, the rod 128 may be part of the snubbing assembly as well. It is to be further appreciated that while the snubber 146 has been shown and described as being arranged on the cap side of the piston 130, the snubber 146 may alternatively be arranged on the rod side of the piston 130. Still other variations of the system and/or combinations of parts of the system may be provided.

Figure 8:
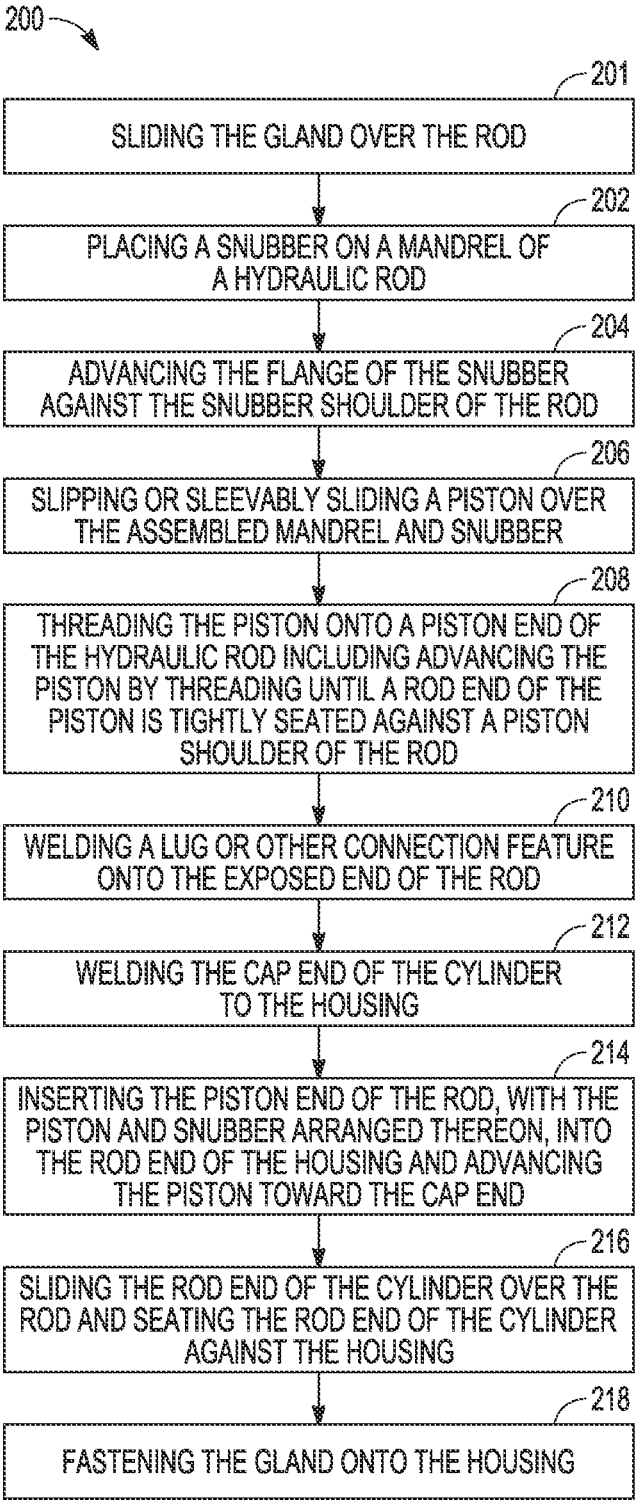
FIG. 8 is a diagram of a method of manufacturing the hydraulic cylinder of FIG. 2, according to one or more embodiments.

The presently disclosed snubbing system may involve a new method of assembly 200 as shown in FIG. 8. For example, a method of assembling a hydraulic cylinder 200 may include sliding a gland over a hydraulic rod 201. The method may also include placing a snubber on a mandrel of a hydraulic rod 202. The snubber may include a relatively loose fitting sleeve portion providing for generally free rotation about the mandrel when seated thereon. The rod may include a snubber shoulder and the snubber may include a flange portion and placing the snubber on the mandrel may include advancing the flange against the snubber shoulder 204. The method may also include slipping or sleevably sliding a piston over the assembled mandrel and snubber 206 and threading the piston onto a piston end of the hydraulic rod 208. The threading may include advancing the piston by threading until a rod end of the piston is tightly seated against a piston shoulder of the rod. A retainer lip on the cap end of the rod bore of the piston may pull the flange portion of the snubber into juxtaposition with the snubber shoulder, but may avoid pinching the flange portion of the snubber such that the snubber remains generally free to rotated on the mandrel and to move laterally slightly. The relatively loose fit of the snubber on the mandrel, the groove inboard of the retainer lip relative to the circumferential edge of the flange portion of the snubber, and the inner diameter of the retainer lip relative to the outer diameter of the snubber sleeve portion may all participate in providing clearance for the snubber to move laterally relatively freely within defined tolerances. As such, when the piston approaches the cap end of the cylinder, the snubber may engage the snubber bore of the cap, the chamfered nose on the free end of the sleeve portion of the snubber may provide a centering function allowing the snubber to align with the snubber bore and enter the snubber bore to cushion the approach of the piston.

The method of assembly may also include welding a lug or other connection feature onto the exposed end of the rod 210 and welding the cap end of the cylinder to the housing 212. The method may also include inserting the piston end of the rod, with the piston and snubber arranged thereon, into the rod end of the housing and advancing the piston toward the cap end 214. The method may also include sliding the rod end of the cylinder over the rod and seating the rod end of the cylinder against the housing. 216 The method may also include bolting or otherwise fastening the gland onto the housing 218 at the rod end. Further assembly method steps may include flooding the cylinder and purging it of air or other gases, for example.

INDUSTRIAL APPLICABILITY

In operation and use, the present hydraulic cylinder may provide for cushioning of the motion of the articulating arms of an excavator, for example, as the cylinders moving the arms are retracted and the piston within the cylinder approaches the cap end of the cylinder. In situations where the cylinder travel has a relatively high speed, this may be advantageous to avoid abrupt stops of the travel, which can cause spillage of material, dropping of material, long term wear or even immediate damage to the hydraulic system due to impacts and pressure spikes, for example. The nature of the presently described snubber assembly may be advantageous by avoiding free floating or loosened or released parts that may get damaged during operation of the hydraulic cylinder and contaminate the hydraulic fluid system. That is, with the absence or reduction of one or more rings, retainer rings, snap rings, and the like in the presently disclosed design, these elements of the system may not be available to break free and get pulverized by the piston and rod motion and contaminate the hydraulic fluid.

The above detailed description is intended to be illustrative, and not restrictive. The scope of the disclosure should, therefore, be determined with references to the appended claims, along with the full scope of equivalents to which such claims are entitled.

What is claimed is:

1. A hydraulic cylinder, comprising:

a housing having a rod end and a cap end, the cap end having a snubbing bore;

a rod having a working end outside the housing and extending through a rod end of the housing to a piston end; and a piston arranged within the housing on the piston end of the rod and configured to reciprocate within the housing between the rod end and the cap end, the piston having a longitudinal bore extending into a cap side of the piston and having a retainer lip, wherein the piston end of the rod comprises a mandrel configured for extending beyond the cap side of the piston and for receiving the snubber; and a snubber configured for engaging the snubbing bore of the cap end when the piston approaches the cap end of the housing, the snubber having an annular flange configured for retention by the retainer lip.

2. The cylinder of claim 1, wherein the snubber comprises a sleeve portion for sleeving over the mandrel.

3. The cylinder of claim 2, wherein the snubber is configured for loosely engaging the mandrel allowing for lateral play in the snubber.

4. The cylinder of claim 3, wherein the snubber comprises a chamfered nose for guiding the snubber into the snubbing bore.

5. The cylinder of claim 1, wherein the longitudinal bore further comprises a groove adjacent and inboard to the retainer lip.

6. The cylinder of claim 5, wherein the rod comprises a snubber shoulder for holding the snubber adjacent the retainer lip.

7. A snubbing assembly for a hydraulic cylinder, comprising:

a piston having a generally cylindrical outer surface and a first end and a second end, the piston configured for securing to a rod of the hydraulic cylinder and having a longitudinal bore extending into the first end of the piston, the longitudinal bore having a retainer lip; and a snubber configured for engaging a snubbing bore of a cap end of the cylinder when the piston approaches the cap end, the snubber having an annular flange configured for retention by the retainer lip, wherein the snubber comprises a sleeve portion for sleeving over a mandrel of the rod.

8. The snubbing assembly of claim 7, wherein the snubber is configured for loosely engaging the mandrel allowing for lateral play in the snubber.

9. The snubbing assembly of claim 8, wherein the snubber comprises a chamfered nose for guiding the snubber into the snubbing bore.

10. The snubbing assembly of claim 7, wherein the longitudinal bore further comprises a groove adjacent and inboard to the retainer lip.

11. The snubbing assembly of claim 7, wherein the first end of the piston is the cap end.

12. The snubbing assembly of claim 11, wherein the longitudinal bore extends fully through the piston and is adapted for threadingly engaging the rod.

13. A method of assembling a hydraulic cylinder, comprising:

placing a snubber on a mandrel of a rod;

sleevably placing the piston over the snubber and securing the piston to the rod until it is seated against a shoulder of the rod, wherein, a seated position of the piston secures a flange of the snubber and allows for radial and longitudinal movement of the snubber relative to the mandrel.

14. The method of claim 13, wherein the piston comprises a retainer lip that secures the position of the snubber.

15. The method of claim 14, further comprising, inserting a piston end of the rod with the snubber and piston arranged thereon, into a housing.

16. The method of claim 13, further comprising welding a cap end of the hydraulic cylinder onto a housing of the hydraulic cylinder.

17. The method of claim 13, wherein securing the piston to the rod comprises threading the piston onto the rod.

18. The method of claim 17, wherein placing the snubber on the mandrel of the rod comprises advancing the flange against a snubber shoulder of the rod.

* * * * *